United States Patent [19]

Wilms et al.

[11] Patent Number: 4,529,541

[45] Date of Patent: Jul. 16, 1985

[54] STABILIZED ZEOLITE A SUSPENSIONS

[75] Inventors: Elmar Wilms, Dormagen; Karl-Dieter Herold; Rainer Salz, both of Düsseldorf, all of Fed. Rep. of Germany

[73] Assignee: Henkel Kommanditgesellschaft, Düsseldorf, Fed. Rep. of Germany

[21] Appl. No.: 643,137

[22] Filed: Aug. 22, 1984

[30] Foreign Application Priority Data

Aug. 22, 1983 [DE] Fed. Rep. of Germany ..... 3330220
Jun. 25, 1984 [DE] Fed. Rep. of Germany ..... 3423351

[51] Int. Cl.[3] ..... C11D 1/83; C11D 3/12; C11D 11/00; C11D 17/08

[52] U.S. Cl. ..... 252/526; 252/140; 252/155; 252/160; 252/173; 252/174.21; 252/174.25; 252/179; 252/531; 252/532; 252/545; 252/550; 252/551; 252/DIG. 14

[58] Field of Search ..... 252/140, 155, 173, 174.21, 252/174.25, 179, 526, 531, 532, 530, 545, 550, 551, DIG. 14, 160

[56] References Cited

U.S. PATENT DOCUMENTS 4,405,483 9/1983 Kuzel ..... 252/140
4,409,136 10/1983 Cheng ..... 252/540
4,438,012 3/1984 Kühling ..... 252/131

*Primary Examiner*—Dennis L. Albrecht
*Attorney, Agent, or Firm*—Ernest G. Szoke; Henry E. Millson, Jr.; Mark A. Greenfield

[57] ABSTRACT

Stabilized aqueous zeolite A suspensions containing a nonionic surfactant as a stabilizer and an anionic surfactant as a stabilizer auxiliary are improved by using at least one sulfated $C_{10-20}$ alcohol or substituted alcohol as the stabilizer auxiliary. In a further embodiment, an acid salt may be added to the suspension to adjust the pH to below 12.

20 Claims, No Drawings

STABILIZED ZEOLITE A SUSPENSIONS

BACKGROUND OF THE INVENTION

1. Field of the Invention

This invention relates to auxiliary stabilizers for an aqueous suspension of synthetic zeolite A, to a process for producing this suspension on an industrial scale and to the use of the suspension for the production of low-phosphate and phosphate-free detergent powders and cleaners.

2. Statement of the Related Art

The use of synthetic zeolites of the A type, particularly zeolite NaA, as a builder in detergents and as a substitute for sodium tripolyphosphate in detergents and cleaners has acquired increasing significance in recent years. Thus, numerous zeolite-containing detergents based on low-phosphate and phosphate-free formulations have already appeared on the market. Moreover, the use of zeolite A as a new water-insoluble detergent ingredient on a commercial scale has also resulted in new developments in detergent technology. In this connection, special mention may be made of the processing of zeolite A in the form of a storable, free-flowing suspension of very high zeolite content. (For the production of zeolite-containing detergents, particularly using stabilized zeolite suspensions, see O. Koch, Seifen-Oele-Fette-Wachse, 106 (1980), pages 321 to 324).

The stabilization of zeolite suspensions which are still free-flowing, even after storage and transport, and which may be stirred and pumped through pipes and also the use of suspensions such as these for the production of detergent powders are known from U.S. Pat. No. 4,072,622 and its divisionals U.S. Pat. Nos. 4,169,075 and 4,438,012, as well as corresponding Canadian Pat. No. 1,071,058 and German patent application No. 25 27 388. A series of six different classes of organic and inorganic compounds have been proposed as stabilizers, including certain substantially insoluble nonionic surfactants. U.S. Pat. No. 4,179,393 and its divisional U.S. Pat. No. 4,264,480, as well as corresponding Canadian Pat. No. 1,084,802 and German patent application No. 27 02 979, recommend certain adducts of amines or glycols with alkylene oxides as stabilizers for aqueous zeolite suspensions. According to the teaching of German patent application No. 26 15 698, the stabilizers according to above-mentioned German patent application No. 25 27 388 are used in conjunction with a stabilizer auxiliary selected from the group comprising non-surface-active, organic and inorganic water soluble salts having molecular weights below 1000, such as sodium sulfate, sodium citrate, sodium tripolyphosphate, sodium carbonate, etc. This provides for greater flexibility in adapting the viscosity of the suspensions to the storage and processing conditions.

In view of the increasing interest being shown by the detergent industry in the use of zeolites instead of triphosphate as a detergent builder, many other proposals have been put forward regarding the production and composition of stabilized aqueous zeolite suspensions. Thus, German patent application No. 28 54 484 (and corresponding European patent application No. 12,346); British patent application No. 2,048,841 (and corresponding German patent application No. 30 16 433); and British patent application No. 2,053,880 (and corresponding German patent application No. 30 26 511); all describe polymeric compounds of very high molecular weight, of the acrylamide/acrylic acid copolymer of ethyl acrylate/methacrylic acid copolymer type, as stabilizers for aqueous zeolite suspensions. Stabilizers based on phosphoric acid mono- or diesters of fatty alcohol ethoxylates are known from German patent application No. 30 30 955. In addition, the use of certain organic and inorganic water soluble salts as stabilizers either on their own or in conjunction with nonionic surfactants is known from a number of publications. Thus, German patent application No. 30 21 295 recommends the use of sodium nitrilotriacetate. On the other hand, water glass solutions, gel-like aluminium oxides or silicon oxides, soaps having a chain length of $C_5$ to $C_{22}$ and sodium salts of the washing alkali type, including sodium hydroxide, are proposed in Japanese patent application Nos. 54/64,504; 55/127,499; 57/34,017; 57/61,615; and 57/67,697.

The requirements which the properties of zeolite suspensions have to satisfy depend to a certain extent on the type of detergents and cleaners in whose production they are to be used. It has been found, however, that if they are to be useable on an industrial scale, the zeolite suspensions must have the following individual properties: stability over a wide temperature range extending from room temperature or lower to at least 70° C.; any sediment formed after prolonged storage must be redispersible by means of stirrers; viscosity should remain low, even at low temperatures, to guarantee stirrability and pumpability; and when the stabilizers zers are incorporated, they should neither dilute the suspension nor affect the pH in any way. Finally, the suspension stabilizers should not cause any problems in the end product detergent, should be highly compatible with all the other ingredients of the detergent and, preferably, should even contribute to the washing and cleaning effect. Of the many previously proposed suspension stabilizers, the substantially insoluble nonionic surfactants, optionally containing an inorganic electrolyte, have so far proved to be the most successful in practice, because these stabilizers and the zeolite suspensions stabilized with them show the requisite properties to a high degree. However, in order to optimize the economic position of aqueous zeolite suspensions as compared to zeolite powders in the production of detergents and cleaners, it was desirable to improve the rheological properties of the zeolite suspensions. This guarantees greater flexibility of use, for example through prolonged stability in storage, transportability and universal suitability for use in the different processes used for producing detergents on an industrial scale.

DETAILED DESCRIPTION OF THE INVENTION

It has now surprisingly been found that stabilized, aqueous zeolite suspensions, which consist of commercially produced zeolite A, water and a stabilizer system containing a water-insoluble nonionic surfactant as suspension stabilizer and an additional stabilizer auxiliary, can be considerably improved in their properties providing the stabilizer auxiliary is an anionic sulfate surfactant comprising (preferably consisting essentially of, most preferably consisting of) at least one water soluble salt of at least one:

(a) sulfuric acid monoester of a $C_{10-20}$ (preferably $C_{12-18}$) primary or a $C_{10-20}$ secondary, straight or branched chain alcohol;

(b) sulfuric acid monoester or semiester of a $C_{10-20}$ (preferably $C_{12-18}$) primary or a $C_{10-20}$ secondary, straight or branched chain alcohol which has first been ethoxylated with about 1–15 (preferably 1–4) mols of ethylene oxide;

(c) sulfuric acid monoester of a $C_{10-20}$ (preferably $C_{12-18}$) fatty alcohol $C_{2-4}$-alkanolamide; or (d) sulfuric acid monoester of a $C_{10-20}$ (preferably $C_{12-18}$) fatty alcohol monoglyceride.

Mixtures of any of the above compounds are useful, particularly a mixture of one or more compounds of (a) with one or more compounds of (b), (c), or (d), (most particularly with one or more compounds of (b)).

The stabilizer system comprising the nonionic stabilizer and the stabilizer auxiliary should be present in a total quantity of about 0.5–5%, preferably about 1–3%, most preferably about 1.5–2.5%. Unless otherwise indicated, all percentages given herein are by weight based upon the total weight of the suspension. Within the above limitations, the quantity of nonionic stabilizer is about 0.2–3% and, independently, the quantity of anionic stabilizer auxiliary is about 0.2–3%. Within the above limitations, the ratio of nonionic stabilizer to anionic stabilizer auxiliary (n:a) is about 0.2–5:1, preferably about 1–3:1.

The suspension according to the invention has a low viscosity and may readily be stirred and pumped over the entire range from ambient temperature to 80° C. In the context of the invention, ambient temperature is the temperature prevailing in the storage and processing rooms which varies from 15° to 25° C., according to the time of year. Even after storage for several days at temperatures in that range, particularly at elevated temperatures of from 50° to 70° C., suspensions according to the invention form only a small, soft sediment which may readily be redispersed by stirring. In addition to favorable stability properties, suspensions according to the invention also show excellent rheological properties which are characterized above all by a narrow viscosity range and by satisfactory flow behavior. In certain machines of the type used industrially for processing zeolite suspensions for the production of detergent powders, the zeolite suspension has to be used in slightly heated form, i.e. above room temperature. In that case, the suspension—if it is be of any use—must remain stable without decomposition over a prolonged period at elevated temperature. In addition, the pH of the aqueous zeolite suspension, which is in the range from about 11 to 14, is not significantly affected by the stabilizer system according to the invention. Where the stabilizer system according to the invention is used, the variation in pH brought about by free alkali present during production on an industrial scale has a considerably reduced effect upon the stability of the suspension.

It has also been found that the viscosities of these suspensions at relatively low temperatures, i.e. below 50° C., can be further reduced, making the suspensions easier to use on a commercial scale. Reducing the viscosity by reducing the zeolite concentration is not a technically feasible measure because, for economic and processing reasons, it is desirable to have high concentrations of zeolite in the suspension.

The further reduction in viscosity is achieved by controlled pH-reduction, i.e. by adjusting the suspensions to a pH from 9 to below 12 and more particularly to a pH of about from 9 to 11 and adjusting that pH by the addition of an acidic salt. The addition of acidic salt generally amounts to between about 0.2 and 3% by weight, based on the weight of the final suspension in which this salt is then present as a neutral salt.

The stabilizer system according to the invention does not adversely affect the calcium binding power of the zeolite. The stabilizer system according to the invention contains a mixture including known washactive substances. Accordingly, the zeolite suspension stabilized with this invention's system is suitable for the production of a large number of detergents and cleaners, because these wash-active substances (which enter the final detergent or cleaner through the zeolite suspension) also contribute towards the washing and cleaning power of the end product.

Aqueous zeolite suspensions containing added dispersants such as water-soluble nonionic surfactants and synthetic organic sulfonate surfactants are known from U.S. Pat. No. 3,254,034 (Dwyer, et al.). These known zeolite suspensions are used for exchanging the sodium cations for cations of the rare earths and for subsequently working up the exchanged zeolites into catalysts. The known suspensions are constantly stirred and therefore are not required to show any particular stability in storage. What is important, however, is that the organic additives can only be selected from readily soluble compounds which, after the cation exchange, may easily be removed by filtration. Accordingly, one concerned with the production and improvement of stabilized zeolite suspensions for further processing into detergents could not derive any assistance from the teaching of Dwyer, et al., because of the different problem involved. In fact the dispersants mentioned in Dwyer, et al., particularly the alkyl benzene sulfonic acids and lignin sulfonic acids recommended therein, have proven to be unsuitable for the purposes of the present invention. Other synthetic sulfonate surfactants, which are generally used in detergents, such as dodecyl benzene sulfonic acid, also have no stability-improving effect upon the zeolite suspensions stabilized with substantially insoluble nonionic surfactants. Nor could any useful information on the stabilization of zeolite suspensions be derived from the related technical field of liquid scouring agents, where numerous proposals have been made with a view to homogenizing and stabilizing the suspensions of finely particulate abrasives. On the contrary, it has been found that the problems to be solved in the stabilization of aqueous pigment suspensions are not of a general nature, but tend to be specific to the particular pigment compound used. Accordingly, the results obtained in the stabilization of specific pigment suspensions, such as titanium dioxide or quartz powder, cannot be used for problem solving purposes in the case of zeolite suspensions.

The pH of aqueous zeolite suspensions which do not contain a stabilizer, or which contain a stabilizer that does not influence the pH, is in the range from pH 11 to 14, i.e. an excess of alkali is present. The excess of alkali is often welcome for further processing into detergents and cleaners because it enters the final detergent as an alkali reserve. If the pH is reduced by further addition of the acidic salt, the corresponding neutral salts are formed and, given a suitable choice of the acidic salts, can themselves act as typical detergent and cleaner ingredients because they impart favorable properties to the end product.

The partial neutralization of freshly prepared alkaline zeolite suspensions is already known as one way of achieving an unrelated objective. Thus, U.S. Pat. No. 4,222,995 (and corresponding Canadian Pat. No.

1,076,096 and German application No. 25 14 399) propose the addition of acid to a suspension of a commercially produced zeolite to lower the pH to 8.5–11 before the subsequent drying step to form a zeolite powder in order to prevent excessive agglomeration of the zeolite particles during drying and the formation of grit (oversize grain). Canadian Pat. No. 1,103,124 (and corresponding German application No. 27 04 310) describe a process for producing zeolite NaA in which an increased alkali content is used to increase the volume/-time yield and the excess alkali is removed after the crystallization step by leaching with water or by the addition of free acid. Finally, U.S. Pat. No. 4,102,977 and divisionals U.S. Pat. Nos. 4,219,535 and 4,238,346 (as well as corresponding Canadian Pat. No. 1,087,152 and German application No. 26 52 409) recommend an addition of acid or an acid salt to the freshly prepared zeolite suspension in such a quantity that the pH does not fall below 9.0. This measure improves the buffer capacity of the zeolite. In the above-mentioned references, it is also mentioned that special precautions have to be taken during addition of the acid to prevent any local overconcentrations of acid and destruction of the acidsensitive zeolite structure.

After the acid salt has been added to the stabilized zeolite suspension, the neutral salt formed from the acid salt is present in dissolved form in the suspension. The above-mentioned German application No. 26 15 698 describes the addition of a non-surface-active, organic or inorganic low molecular weight salt as a stabilizing aid to a stabilized zeolite suspension and it is known from European patent application No. 870 (and corresponding German application No. 27 38 085) that the flow properties of zeolite suspensions can be improved by the addition of sodium sulfate neutral salt. However, this prior art taken either separately or combined does not suggest additionally introducing an acid salt into an aqueous zeolite suspension already stabilized by a stabilizer system comprising a nonionic surfactant and a sulfate surfactant for the purpose of controlled pH-adjustment and thus arriving at the desired narrow range of low viscosity which is virtually independent of temperature.

Referring more specifically to the above-described stabilizer auxiliary, it is preferred to use the sulfuric acid monoester of a primary $C_{12-18}$-alkanol and/or its reaction product with ethylene oxide, both in the form of watersoluble salts. $C_{12-18}$-fatty alcohols obtainable from natural fats are particularly preferred for the production of the (sulfate surfactant) stabilizer auxiliaries. Derivatives such as these combine particularly favorable stabilizing properties with satisfactory biodegradability and ready obtainability from natural renewable raw materials.

Useful sulfate surfactants in accordance with the invention are: tallow alcohol sulfate (TAS) ("tallow alcohol" being a hydrogenated $C_{14-18}$-tallow fatty alcohol mixture); lauryl alcohol sulfate; cocoalcohol sulfate (COAS) ("cocoalcohol" being a $C_{12-18}$-cut of natural coconut oil fatty alcohol); lauryl alcohol ether sulfate (LAES) (produced from a $C_{12-14}$ fatty alcohol reacted with 2 to 3 mols of ethylene oxide); coco-/tallow alcohol sulfate (produced from coco and tallow alcohol in a ratio of 1:1); cetyl/stearyl alcohol sulfate (LANETTE E, a Henkel product); and/or tallow alcohol-2 E.O.-sulfate. Examples of useful sulfated fatty alcohol alkaolamides include the sodium salts of: sulfated coconut fatty acid monoethanol amide; sulfated lauric acid monoethanol amide; and sulfated coconut fatty acid diethanol amide. An example of a useful sulfated fatty alcohol monoglyceride is the sodium salt of sulfated glycerol monooleate. The sulfate surfactants are preferably used in the form of their sodium, ethanolamine, or triethanolamine salts, most preferably sodium.

The substantially water-insoluble nonionic surfactants used as suspension stabilizers are compounds which have a cloud point, as determined by the method according to Deutsche Industrienormalien (DIN) 53 917 in aqueous butyl diglycol solution at 90° C. and lower, preferably at 85° C. and lower. These nonionic surfactants are described in detail in U.S. Pat. No. 4,072,622, Canadian Pat. No. 1,071,058, and their above-mentioned related patents, as well as in German application No. 26 15 698. Typical representatives of these substantially waterinsoluble nonionic surfactants, which have proven to be particularly useful, are: tallow alcohol polyglycol ether with 5 mols of ethylene oxide (TA 5 EO); cocoalcohol-($C_{12-18}$-cut)-polyglycol ether with 4 mols of ethylene oxide; oleyl alcohol polyglycol ether with 5 mols of ethylene oxide; oleyl/cetyl alcohol polyglycol ether with 7 mols of ethylene oxide (produced from an alcohol mixture having an iodine number of from 50 to 55); $C_{14-15}$-oxoalcohol polyglycol ether with 4 mols of ethylene oxide; and/or nonyl phenol polyglycol ether with 5 mols of ethylene oxide.

The acid salt is generally used in a quantity of from 0.2 to 3% by weight, based on the weight of the final suspension. In individual cases, it may even be used in quantities beyond or below those limits. In all instances, the quantity in which the acid salt is added depends upon the pH of the moist zeolite filter cake or of the zeolite suspension at the end of the zeolite production process. Accordingly, the pH is dependent not only upon the choice of the zeolite production process, but also upon the extent to which the zeolite is leached with water. The acid salt is added in solid form or in the form of a concentrated aqueous solution in small portions and with stirring.

Acid salts suitable for use in accordance with the invention are, primarily, inorganic acid salts, particularly the acid salts of sulfuric acid, carbonic acid, phosphoric acid, polyphosphoric acid, boric acid and silicic acid. Acid salts of the foregoing inorganic acids with alkali metals or alkaline earth metals are particularly useful and include $NaHSO_4$, $KHSO_4$, $NaH_2PO_4$, $MgHPO_4$, and $Ca(H_2PO_4)_2$, among others, of which $NaHSO_4$ and $NaH_2PO_4$ are preferred. It is also possible, although less preferred, to use the acid salts of polybasic organic acids such as citric acid, diglycolic acid, gluconic acid, polyacrylic acid, nitrilotriacetic acid, hydroxyethane diphosphonic acid and analogous hydroxyalkane and aminoalkane polyphosphonic acids. Although the acid salts of other inorganic and organic acids are also suitable in principle, preference is given to those acid salts which, after partial neutralization, exist as neutral salts and perform a favorable function in the production of the detergent and cleaner or during the washing or cleaning process. Accordingly, very useful acid salts may be defined as the salts of polybasic acids which contain at least one alkali or ammonium cation and which react with the alkali in the aqueous zeolite suspension, accompanied by partial neutralization.

The zeolite A used in accordance with the invention may be produced from sodium silicate and sodium aluminate solutions or from destructured kaolin and sodium hydroxide by hydrothermal synthesis using any of several known processes. There are several known processes for the industrial production of zeolite A for detergent purposes, in which the zeolite A crystals accumulate with rounded corners and edges and in which the formation of grit is avoided by specific process parameters. Processes of the above type are described in numerous patents, of which the following are exemplary:

| Zeolite A process patent/application equivalents | | |
|---|---|---|
| U.S. (Pat. No.) | Canada (Patent) | Germany (Application) |
| 4,055,622 | 1,068,669 | 25 33 614 |
| 4,073,867 | 1,073,430 | 25 17 218 |
| 4,271,135 | 1,117,733 | 27 34 296 |
| 4,303,626 | 1,083,123 | 26 51 420 |
| 4,303,627 | 1,083,554 | 26 51 437 |
| 4,303,628 | 1,082,163 | 26 51 419 |
| 4,303,629 | 1,082,161 | 26 51 485 |
| 4,305,916 | 1,082,162 | 26 51 436 |
| 4,339,244 | 1,161,817 | 30 21 370 |
| 4,371,510 | 1,141,741 | 29 41 636 |
| — | 1,057,272 | 24 47 021 |
| — | 1,083,553 | 26 51 445 |
| — | 1,103,124 | 27 04 310 |
| — | 1,148,919 | 30 11 834 |

Where it is produced by hydrothermal synthesis, the zeolite A generally accumulates in the form of a moist filter cake having a water content of approximately 50 to 60% by weight. By virtue of its thixotropic properties, this filter cake may readily be stirred immediately after production and the suspension stabilizer may be directly added thereto.

The suspensions according to the invention may be prepared simply by mixing the constituents. In practice, it is preferred to use an aqueous suspension of the zeolite which is still moist from its production and has not been dried, in which case the moist filter cake obtained after separation of the mother liquor and washing with water is converted by stirring into a free-flowing suspension. There is generally no need for more water to be added. In the case of the nonionic surfactants, the stabilizing agents are used in undiluted form and, in the case of the anionic sulfate surfactants, in the form of the commercially available, aqueous concentrates of the sodium salts or in the form of granulates, flakes or noodles. The amount of water additionally introduced with paste-form concentrates is small so that it does not affect the concentration of zeolite in the stabilized suspension. The suspensions according to the invention may be produced with zeolite concentrations of as little as 20% by weight. However, the water content of the suspensions should be kept as low as possible for economic reasons, i.e. to save transport and energy costs. Thus, it is desirable to adjust the zeolite content to levels above 40% by weight and, if possible, to levels of around 50% by weight. The production of the suspensions according to the invention is generally carried out at elevated temperatures, such as about 50° C., to accelerate the mixing process.

It is also possible to use an already dried zeolite powder for producing the suspensions according to the invention in cases where a zeolite filter cake still moist from production is not available.

For further processing the stabilized zeolite suspensions are used as a liquid starting material in the processes normally used for producing detergents and cleaners. Particular commercial significance is attributed to the use of the stabilized zeolite suspensions for the production of detergent powders by the hot spray drying method, in which case the slurry is prepared using the zeolite suspension and subsequently converted into a detergent powder in the usual way in spray drying towers. In special cases, for example where it is intended to produce powder-form initial and intermediate products, the suspension according to the invention may also be converted into a spray-dried powder as such or after the addition of further detergent ingredients. One particular property which the spray-dried suspension has been found to exhibit is that the resulting powder may be redispersed in water to form a stable suspension, which widens the range of practical applications of the suspensions according to the invention.

EXAMPLES

I. Stabilizer System of Nonionic Surfactant and Anionic Sulfate Surfactant

A moist filter cake of zeolite NaA having the following properties was used for producing the stabilized suspensions:

Content of zeolite NaA, based on the anhydrous substance (ignition residue after heating for 1 hour to 800° C.): 47.0%

Calcium binding power: 163 g of CaO/g of anhydrous substance (as determined by the method described below);

Particle size distribution (Coulter Counter, volume distribution) 100% smaller than 15μ; 98.1% smaller than 10μ; 79% smaller than 5μ; 36.5% smaller than 3μ;

Average particle diameter: 3.9μ;

Alkali content: 0.35% by weight.

Procedure for Determining Calcium Binding Power

1 Liter of an aqueous solution containing 0.594 g of $CaCl_2$ (corresponding to 300 mg of CaO/1 =30° d) was adjusted with dilute sodium hydroxide to a pH of 10, followed by the addition with stirring of 2.13 g of the filter cake (=1.00 g of anhydrous zeolite A). The suspension was then stirred for 10 minutes at a temperature of 22±2° C. After the zeolite had been filtered off, the residual hardness X in the filtrate was determined by complexometric titration with ethylene diamine tetracetic acid; the calcium binding power in mg of CaO/g is then calculated in accordance with the formula: (30 −X). 10.

General Method for Producing the Stabilized Zeolite A Suspensions

Batches of 1 kg of the fresh, moist zeolite A filter cake (water content approximately 53% by weight, temperature 60° C.) were stirred (stirring speed approximately 500 r.p.m.). Under these conditions, the filter cake is converted into a readily stirrable suspension. The mixture of stabilizer and stabilizer auxiliary was introduced into this suspension. The additives which are solid or viscous at room temperature were first liquified on a steam bath and then added. Duration of the mixing process was approx. 2 to 3 minutes.

EXAMPLE 1

This Example demonstrates the dependence of the viscosity of the stabilized zeolite A suspension on the temperature. The stabilized suspension had the following composition:

1.5% by weight of tallow fatty alcohol reacted with 5 mols of ethylene oxide (TA 5 E.O.) [NONIONIC STABILIZER],
0.8% by weight of tallow fatty alcohol sulfate (TAS) [STABILIZER AUXILIARY],
46.0% by weight of zeolite NaA,
0.35% by weight of sodium oxide,
remainder water.

The stabilized suspension was compared with a conventional stabilized suspension containing only 1.5% by weight of TA 5 E.O., i.e., without the invention's stabilizer auxiliary.

Viscosity was determined using a Brookfield viscosity meter (20 r.p.m., spindle according to the viscosity range.).

| Temperature (°C.) | Viscosity (mPa · s) invention | prior art |
|---|---|---|
| 25 | 9000 | 14000 |
| 30 | 4000 | 13000 |
| 35 | 2000 | 9000 |
| 40 | 7000 | 6000 |
| 45 | 5500 | 3000 |
| 50 | 2000 | 400 |
| 55 | 1500 | — |
| 60 | 1000 | — |
| 65 | 1000 | — |
| 70 | 800 | 500 |

Comparison of the above viscosity values shows that the suspension according to the invention behaves comparably in regard to its viscosity over most of the entire temperature range, the exceptions being at 30° and 35° C. By contrast, the prior art viscosity decreases uniformly to about 50° C. and then seems to level off abruptly.

EXAMPLES 2 to 4

These Examples describe standing tests involving three suspensions according to the invention and a known suspension (cf. Example 1). The stored suspensions are assessed on the basis of sedimentation and sediment consistency.

Test Procedure 250 ml. screw-top glass flasks were used as containers for the storage test. The filling level of the freshly introduced suspension was put at 100%. After the storage period, the height of the clear liquid zone over the suspension was measured and the sedimentation behavior expressed in "% suspension". Accordingly, "100% suspension" means that no clear liquid phase had formed.

In addition, the consistency of the sediment which had formed after storage was tested in the same vessels by probing with a glass rod. In assessing the sediment, it is not only a question of whether and to what extent a sediment has formed, but also of whether this sediment can be redispersed easily, with difficulty, or not at all. Accordingly, the following marking system was adopted:

O=no sediment in the suspension;
R=slight sediment, soft and readily redispersible;
S=sediment of soft consistency, readily redispersible;
M=sediment of medium consistency, difficult to redisperse;
H=sediment of hard consistency, non-redispersible.

The storage tests were carried out at room temperature (RT), 35° C., 50° C. and 70° C. The viscosity of the suspensions was also measured at those temperatures before storage. During the storage period, no change in viscosity was observed in the case of the completely homogeneous suspensions or in the case of the redispersed suspensions which had developed a sediment of soft consistency.

In Examples 2 to 4, the abbreviations TA 5 E.O. and TAS have the meanings defined in Example 1. COAS stands for coconut oil fatty alcohol sulfate, sodium salt ($C_{14-18}$-cut). LAES stands for lauryl alcohol ($C_{12-14}$)-ether sulfate, sodium salt (with approx. 2 mols of E.O.).

The storage tests show (cf. Table below) that the suspensions according to the invention are stable, even at elevated temperature, and may satisfactorily be further processed after storage. This improved stability at elevated temperature is particularly advantageous in cases where the suspension has to be used at elevated temperature or heated to elevated temperature during its further processing.

If mixtures of zeolite NaA and hydrosodalite in a ratio of about 10:1 to 1:1, or mixtures of zeolite NaA and zeolite NaX, are used instead of zeolite NaA for producing the suspensions, comparable stability properties are observed.

| Example No. | 2 | | | | 3 | | | 4 | | | comparative | | | |
|---|---|---|---|---|---|---|---|---|---|---|---|---|---|---|
| NONIONIC STABILIZER | 1.5% TA 5 E.O. | | | | 1.5% TA 5 E.O. | | | 2.0% TA 5 E.O. | | | 1.5% TA 5 E.O. | | | |
| STABILIZER | 0.8% TAS | | | | 0.8% TAS | | | 0.5% LAES<br>0.5% COAS | | | none | | | |
| % zeolite NaA | 46 | | | | 46 | | | 46 | | | 46 | | | |
| % free $Na_2O$ | 0.35 | | | | 0.35 | | | 0.35 | | | 0.35 | | | |
| pH of the suspension | 13.0 | | | | 13.0 | | | 13.0 | | | 13.0 | | | |
| Viscosity (mPa.s) | | | | | | | | | | | | | | |
| at RT | 9000 | | | | 5000 | | | 5000 | | | 14000 | | | |
| at 35° C. | 2000 | | | | 3000 | | | 3700 | | | 9000 | | | |
| at 50° C. | 2000 | | | | 1000 | | | 1000 | | | 400 | | | |
| at 70° C. | 800 | | | | — | | | — | | | 500 | | | |
| (temperature) | RT | 35° | 50° | 70° | RT | 35° | 50° | RT | 35° | 50° | RT | 35° | 50° | 70° |
| % suspension | | | | | | | | | | | | | | |
| after 1 day | 100 | 100 | 98 | 98 | 98 | 98 | 98 | 97 | 97 | 95 | 99 | 98 | 90 | 90 |
| after 2 days | 100 | 100 | 98 | 98 | 98 | 98 | 98 | 97 | 95 | 90 | 99 | 98 | 90 | 85 |
| after 5 days | 100 | 100 | 98 | 95 | 95 | 98 | 98 | 95 | 95 | 90 | 99 | 98 | 90 | 80 |
| after 7 days | 100 | 100 | 98 | 95 | 95 | 98 | 98 | 95 | 95 | 90 | 99 | 95 | 90 | 80 |
| Sediment consistency | | | | | | | | | | | | | | |
| after 1 day | O | O | O | O | O | O | O | O | O | O | O | O | H | H |
| after 2 days | O | O | O | O | O | O | O | O | O | S | O | O | H | H |
| after 5 days | O | O | O | R | R | R | O | O | R | M | O | S | H | H |

-continued

| Example No. | 2 | | | 3 | | | 4 | | | comparative | | | | |
|---|---|---|---|---|---|---|---|---|---|---|---|---|---|---|
| after 7 days | O | O | O | R | R | R | O | S | S | M | S | S | H | H |

II. Stabilizer System According to this Invention, Further Containing an Added Acid Salt The zeolite A filter cake used had the following properties:

Zeolite A content: 46%;

Calcium binding power: 160 mg of CaO/g;

Particle size: 100% smaller than 25μ; 95% smaller than 10μ; 71% smaller than 5μ; 18% smaller than 3μ;

Average particle diameter: 4.0μ;

Alkali content: 0.35% by weight.

To prepare the stabilized zeolite A suspensions, batches of 1 kg of the fresh, moist zeolite A filter cake (Water content approximately 54% by weight, temperature 60° C.) were agitated (stirring speed approximately 500 r.p.m.). Under these conditions, the filter cake was converted into a readily stirrable suspension. First the acid salt and then the mixture of stabilizer and stabilizing auxiliary were introduced into that suspension. The additives which are solid or viscous at room temperature were first liquified on a steam bath and then added. Duration of the mixing process: approx. 2 to 3 minutes. The salt was added in solid, finely divided form.

EXAMPLE 5

This Example demonstrates the dependence of the viscosity of the stabilized zeolite A suspension on the temperature. The stabilized suspension had the following composition:

1.5% by weight of tallow fatty alcohol reacted with 5 mols of ethylene oxide (TA 5 E.O.) [STABILIZER], 0.5% by weight of tallow fatty alcohol sulfate (TAS), [STABILIZER AUXILIARY], 44.0% by weight of zeolite NaA, 0.6% by weight addition of $NaHSO_4$, remainder water.

The inventive stabilized suspension was compared with a conventional 35 stabilized suspension containing only 1.5% by weight of TA 5 E.O. and having a pH of 13.5. Viscosity was determined using a Brookfield viscosimeter (20 r.p.m., spindle according to the viscosity range).

| Temperature (°C.) | Viscosity (mPa · s) invention | prior art |
|---|---|---|
| 25 | 600 | 14000 |
| 35 | 600 | 9000 |
| 50 | 400 | 400 |
| 60 | 300 | — |
| 70 | 200 | 500 |

EXAMPLES 6 and 7

These Examples describe standing tests involving a suspension according to the invention and, for comparison, a known suspension. The stored suspensions are assessed on the basis of sedimentation and sediment consistency. For the test procedure, see Examples 2–4. The viscosity of the suspensions was measured before storage. During the period of storage, no change in viscosity was observed in the case of the completely homogeneous suspensions or in the case of the redispersed suspensions which had developed a sediment of soft consistency. The storage tests reveal (cf. Table below) a low viscosity of the suspension according to the invention at room temperature and a slight increase in viscosity when the temperature is increased to 70° C. The suspension according to the invention is stable both at room temperature and also at elevated temperature and may be satisfactorily further processed after storage.

If mixtures of zeolite NaA and hydrosodalite in a ratio of about 10:1 to 1:1, or mixtures of zeolite NaA and zeolite NaX are used instead of zeolite NaA for producing the suspensions, comparable viscosity and stability properties 30 are observed. If, in Example 6, the acid salt $NaHSO_4$ is replaced by $NaH_2PO_4$ or if the stabilizer TA 5 is replaced by the same quantity of a mixture of oleyl and cetyl alcohol (iodine number 50-55) reacted with 4 or 6 mols of ethylene oxide in a ratio of 1:1, comparable viscosity and stability properties are again observed.

| Example No. | 6 | | | | 7 (comparative) | | | |
|---|---|---|---|---|---|---|---|---|
| STABILIZER | 1.5% TA 5 E.O. | | | | 1.5% TA 5 E.O. | | | |
| STABILIZER AUXILIARY | 0.5% TAS | | | | none | | | |
| ACID SALT | 0.6% $NaHSO_4$ | | | | none | | | |
| % zeolite NaA | 44 | | | | 46 | | | |
| % free $Na_2O$ | 0.18 | | | | 0.35 | | | |
| pH of the suspension | 11.9 | | | | 13.0 | | | |
| Viscosity (mPa · s) | | | | | | | | |
| at RT | 600 | | | | 14000 | | | |
| at 35° C. | 600 | | | | 9000 | | | |
| at 50° C. | 400 | | | | 400 | | | |
| at 70°C. | 200 | | | | 500 | | | |
| (temperature) | RT | 35° | 50° | 70° | RT | 35° | 50° | 70° |
| % suspension | | | | | | | | |
| after 1 day | 100 | 100 | 100 | 100 | 99 | 98 | 90 | 90 |
| after 2 days | 100 | 100 | 100 | 100 | 99 | 98 | 90 | 85 |
| after 5 days | 98 | 98 | 98 | 98 | 99 | 98 | 90 | 80 |
| after 7 days | 98 | 98 | 98 | 98 | 99 | 95 | 90 | 80 |
| Sediment consistency | | | | | | | | |
| after 1 day | O | O | O | O | O | O | H | H |
| after 2 days | O | O | O | O | O | O | H | H |
| after 5 days | O | O | S | S | O | S | H | H |
| after 7 days | S | S | S | S | S | S | H | H |

We claim:

1. A stabilized aqueous zeolite suspension with improved stability comprising: water; zeolite A in an amount of about 20 to 50%; and a stabilizer system present in an amount of about 0.5 to 5%, said stabilizer system comprising a water-insoluble nonionic surfactant as a suspension stabilizer present in an amount of about 0.2 to 3% and an anionic stabilizer auxiliary independently present in an amount of about 0.2 to 3%; all percentages being by weight based upon the total weight of the suspension and the pH of said suspension being adjusted to about from 9 up to below 12; wherein said stabilizer auxiliary is an anionic sulfate surfactant comprising at least one water-soluble salt of at least one:

(a) sulfuric acid monoester of a $C_{10-20}$ primary or $C_{10-20}$ secondary, straight or branched chain alcohol;

(b) sulfuric acid monoester or semiester of a $C_{10-20}$ primary or $C_{10-20}$ secondary, straight or branched chain alcohol which has first been ethoxylated with about 1–15 mols of ethylene oxide;

(c) sulfuric acid monoester of a $C_{10-20}$ fatty alcohol-$C_{2-4}$-alkanolamide; or (d) sulfuric acid monoester of a $C_{10-20}$ fatty alcohol monogylceride.

2. The suspension of claim 1 wherein said stabilizer auxiliary is at least one sodium, ethanolamine or triethanolamine water-soluble salt of at least one (a) sulfuric acid monoester of a $C_{12-18}$ primary or $C_{10-20}$ secondary, straight or branched chain alcohol;

(b) sulfuric acid monoester or semiester of a $C_{12-18}$ primary or $C_{10-20}$ secondary, straight or branched chain alcohol which has first been ethoxylated with about 1–4 mols of ethylene oxide;

(c) sulfuric acid monoester of a $C_{12-18}$ fatty alcohol-$C_{2-4}$-alkanolamide; or (d) sulfuric acid monoester of a $C_{12-18}$ fatty alcohol monoglyceride.

3. The suspension of claim 1 wherein said stabilizer auxiliary is:

a mixture of compounds from any one of (a), (b), (c), or (d);

a mixture of at least one compound of (a) with at least one compound of (b), (c), and/or (d); or a mixture of at least one compound of (a) with at least one compound of (b).

4. The suspension of claim 1 wherein said stabilizer system is present in an amount of about 1 to 3%.

5. The suspension of claim 1 wherein said stabilizer system is present in an amount of about 1.5 to 2.5%.

6. The suspension of claim 1 wherein the weight ratio of said nonionic stabilizer to said anionic stabilizer auxiliary is about 0.2–5:1.

7. The suspension of claim 1 wherein the weight ratio of said nonionic stabilizer to said anionic stabilizer auxiliary is about 1–3:1.

8. The suspension of claim 1 wherein the weight ratio of said nonionic stabilizer to said anionic stabilizer auxiliary is about 0.2–5:1,.

9. The suspension of claim 1 wherein an acid salt is present in said stabilized aqueous zeolite suspension in an amount effective to adjust the pH.

10. The suspension of claim 9 wherein the amount of acid salt is effective to adjust the pH to about 9 to 11.

11. The suspension of claim 9 wherein said acid salt is derived from at least one of sulfuric, carbonic, phosphoric, polyphosphoric, boric, or silicic acids.

12. The suspension of claim 11 wherein said acid salt is an alkali metal or alkaline earth metal salt.

13. The suspension of claim 12 wherein said acid salt is at least one of $NaHSO_4$, $KHSO_4$, $NaH_2PO_4$, $MgHPO_4$, or $Ca(H_2PO_4)_2$.

14. The suspension of claim 12 wherein said acid salt is $NaHSO_4$ and/or $NaH_2PO_4$.

15. The suspension of claim 1 wherein said acid salt is present in said stabilized aqueous zeolite suspension in an amount of about 0.2 to 3% by weight based upon the total weight of the suspension.

16. The suspension of claim 8 wherein an acid salt is also present in an amount of about 0.2 to 3% by weight.

17. The suspension of claim 1 wherein:

(a) is a sulfuric acid monoester of a primary $C_{12-18}$-alkanol;

(b) is a sulfuric acid monoester of a primary $C_{12-18}$-alkanol which has first been ethoxylated with about 1–4 mols of ethylene oxide;

and said stabilizer auxiliary is a mixture of at least one compound of (a) with at least one compound of (b).

18. The suspension of claim 1 wherein:

(a) is a sodium salt of a sulfuric acid monoester of a $C_{12-18}$-fatty alcohol;

(b) is a sodium salt of a sulfuric acid semiester of a $C_{12-18}$-fatty alcohol which has first been ethoxylated with about 1–4 mols of ethylene oxide;

and said stabilizer auxiliary is a mixture of at least one compound of (a) with at least one compound of (b).

19. The suspension of claim 1 wherein said stabilizer auxiliary is a sodium, ethanolamine or triethanolamine salt of: a sulfated hydrogenated $C_{14-18}$-tallow fatty alcohol mixture; lauryl alcohol sulfate; a sulfated $C_{12-18}$-cut of natural coconut oil fatty alcohol; a sulfated $C_{12-14}$-fatty alcohol first ethoxylated with 2 to 3 mols of ethylene oxide; a 1:1 coco-/tallow alcohol sulfate; a cetyl/-stearyl alcohol sulfate; a sulfated $C_{14-18}$-tallow fatty alcohol mixture first ethoxylated with 2 mols of ethylene oxide; a sulfated coconut fatty acid monoethanolamide; a sulfated lauric acid monoethanolamide; a sulfated coconut fatty acid diethanolamide, a sulfated glycerol monooleate; or any mixture of the foregoing.

20. The suspension of claim 1 wherein an acid salt is present in said stabilized aqueous zeolite suspension in an amount effective to adjust the pH to about from 9 up to below 12, and said acid salt is the alkali metal or alkaline earth metal salt of sulfuric, carbonic, phosphoric, polyphosphoric, boric, or silicic acids, or any mixture thereof.

* * * * *